US008544938B2

(12) United States Patent
Ackermann

(10) Patent No.: US 8,544,938 B2
(45) Date of Patent: Oct. 1, 2013

(54) DOOR PROTECTION DEVICE FOR A VEHICLE

(76) Inventor: Klaus Ackermann, Munich (DE)

( * ) Notice: Subject to any disclaimer, the term of this patent is extended or adjusted under 35 U.S.C. 154(b) by 0 days.

(21) Appl. No.: 13/179,786

(22) Filed: Jul. 11, 2011

(65) Prior Publication Data

US 2012/0187718 A1 Jul. 26, 2012

(30) Foreign Application Priority Data

Jan. 21, 2011 (DE) ..... 10 2011 009 117

(51) Int. Cl.
*F41H 7/02* (2006.01)

(52) U.S. Cl.
USPC ..... 296/187.07; 89/36.07

(58) Field of Classification Search
USPC ..... 296/187.07; 89/36.01–36.09, 36.16; 109/77, 74, 75, 76, 49.5
See application file for complete search history.

(56) References Cited

U.S. PATENT DOCUMENTS

| | | | | |
|---|---|---|---|---|
| 4,567,100 | A * | 1/1986 | Pickett et al. | 428/339 |
| 4,598,647 | A * | 7/1986 | Biedess | 109/77 |
| 4,741,277 | A * | 5/1988 | Salzer | 109/77 |
| 5,808,228 | A * | 9/1998 | Beschle et al. | 89/36.02 |
| 7,357,060 | B2 * | 4/2008 | Muller et al. | 89/36.02 |
| 2003/0189131 | A1 * | 10/2003 | Cloud et al. | 244/118.5 |
| 2005/0205315 | A1 * | 9/2005 | Gordon | 180/68.1 |
| 2006/0213361 | A1 * | 9/2006 | Muller et al. | 89/36.02 |
| 2008/0314236 | A1 * | 12/2008 | Savage et al. | 89/36.02 |

FOREIGN PATENT DOCUMENTS

| | | |
|---|---|---|
| DE | 19628065 | 1/1998 |
| DE | 19960944 | 5/2000 |
| DE | 102005060604 | 4/2007 |

OTHER PUBLICATIONS

Definition of "component" as seen in Merriam Webster's Collegiate Dictionary, 10th edition, 1996.*

* cited by examiner

*Primary Examiner* — H Gutman
(74) *Attorney, Agent, or Firm* — Andrew M. Calderon; Roberts Mlotkowski Safran & Cole, P.C.

(57) ABSTRACT

A vehicle door safety device for a vehicle, especially for an armored vehicle, includes at least one door casing which runs peripherally essentially in the side edges of the vehicle door and which is located on the inside of a vehicle door leaf, and of at least one body casing which is arranged running peripherally on the door frame of the vehicle body. The casings of the inside of the door leaf and of the door frame mutually supplement one another in a complementary manner, each being made with at least one component such that they overlap one another in the closed position of the vehicle door, as a result of which a gap between the casings is covered.

16 Claims, 1 Drawing Sheet

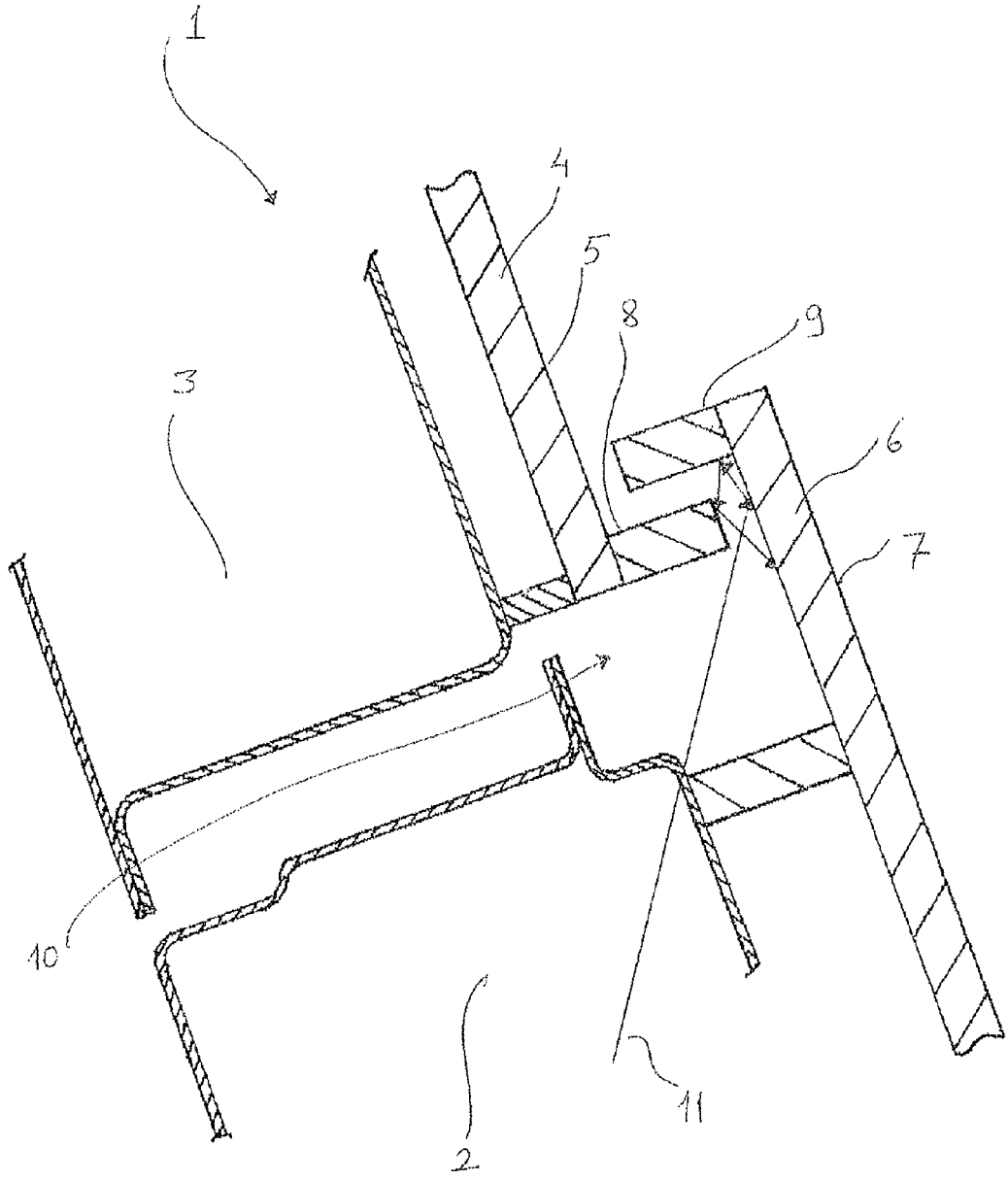
1
4
5
8
9
3
6
7
10
11
2

DOOR PROTECTION DEVICE FOR A VEHICLE

FIELD OF THE INVENTION

This invention relates to a vehicle door safety device for a vehicle, especially for an armored vehicle, which consists of at least one door casing which runs peripherally essentially in the side edges of the vehicle door and which is located on the inside of a vehicle door leaf and of at least one body casing which is arranged running peripherally on the door frame of the vehicle body.

DISCUSSION OF BACKGROUND INFORMATION

In armored vehicles, door regions form especially sensitive sites since there is always a gap between two door parts, specifically between the door frame and door leaf sides, through which in the case of an attack or an explosion penetration of projectiles or splinters is possible. Various suggestions have been made to prevent risks in this hazard situation.

DE 10 2005 060 604 B3 discloses a protective device in which a protective profile is attached to one vehicle door of an armored passenger vehicle and projects into a door gap between the vehicle door and a body-side door casing. On the side facing the vehicle door an armoring element is attached to the door casing, is opposite the section of the protective profile projecting into the door gap and narrows the door gap as a result of its thickness. Thus both the protective profile and also the armoring element reduce the width of the door gap and thus prevent penetration of projectiles into the vehicle interior.

DE 199 60 944 A1 discloses a special-purpose protective vehicle with a reinforcing component which is designed for protection of vehicle passengers against violent external effects and which is connected to the body of a special-purpose protective vehicle by a screw union. The screw union is provided with a sloped surface which is tilted relative to the longitudinal axis of the screw union on its end section facing the outside of the special-purpose protective vehicle. In this way, striking projectiles will be deflected from the longitudinal axis of the screw union so that the danger of violent detachment of the screw union from the individual parts is precluded. This has the disadvantage that it does not always work. It works only if projectiles strike with an angle of 90°. Moreover the aforementioned device is relatively complex.

DE 196 28 065 A1 discloses a protective device for a door gap between a door leaf and a body-side door frame of an armored protective vehicle which is designed to prevent projectile splinters from penetrating into the vehicle interior and to reduce the size of the door opening as little as possible with the door leaf opened. For this purpose, bulkheads project from the casing of the door leaf into the door gap. In this way the gap-covering armor which projects into the door opening region via the door frame with one door leaf opened can have a relatively small extension into the free door opening space. One of the projectile-deflecting bulkheads on the casing of the door leaf is a splinter protection strip which projects into the door gap, which is attached to the inside of the door leaf, and which prevents penetration of parts of an exploded projectile into the vehicle interior or deflects penetrating parts into regions which are not critical to vehicle passengers. This device has the disadvantage that the gap is not made small enough so that a projectile can penetrate into the vehicle interior without major hindrance. A protective strip alone is not enough to make the gap smaller.

Therefore the object of the invention is to devise a way in which in or on a vehicle of the initially named type a door safeguard for optimum protection of passengers can be easily made with relatively low cost.

SUMMARY OF THE INVENTION

This object is achieved as claimed in the invention by the characterizing features of claim 1 the claimed invention.

Other advantageous configurations are given by the features of the claimed invention and as described herein.

This invention is based on the idea that a vehicle door protective device, especially for an armored vehicle, which consists of a door casing which runs peripherally essentially in the side edges of the vehicle door and which is located on the inside of the vehicle door leaf, and of at least one body casing which is located running peripherally on the door frame of the vehicle body, the frames of the inside of the door leaf and of the door frame which mutually supplement one another in a complementary manner each being made with at least one component, that they overlap one another in the closed position of the vehicle door, as a result of which a gap between the casings is covered. In this way the safety of the passengers of the vehicle is increased to the maximum degree, in which double protection for vehicle passengers is ensured. Action of a force from the outside in the form of penetration of a projectile or splinter parts in an explosion is avoided as a result of the complete covering of the door gap. This takes place regardless of from what angle an attack takes place or strikes the vehicle door. Moreover the structures of the door frame and of the door leaf are not changed by this vehicle door safety device as claimed in the invention. Thus a weight increase and associated efforts are avoided.

According to one feasible configuration of the invention, the component of the vehicle door safety device is made in one piece. In this way, on the one hand economical production is achieved, on the other hand based on this mechanical property the safety is increased since the gap of the vehicle doors is thus completely covered along their entire pillars or casings.

According to another advantageous configuration of the invention the component on the inside of the door leaf is made such that it overlaps, encompassing the component from the door frame of the vehicle body. The component of the door leaf is made with a larger diameter than the diameter of the component of the door frame. In this way the gap between the door frame and the door leaf is better covered to prevent penetration of a projectile or splinter parts through the door in the case of an attack. As claimed in the invention, the components are made such that each encompasses the casing which belongs to it at least once. By encompassing the entire casing from the component on the inside of the door leaf and the one on the door frame of the vehicle body the gap from the two sides is covered such that the passengers of the vehicle are better protected against attacks.

According to one advantageous configuration of the invention the two components which are sloped relative to one another are arranged such that in the action of the force of a projectile on its surfaces with this angle, repeated reflection takes place. In this way a projectile, regardless of from which angle an attack takes place, is deflected by a plurality of barriers and its penetration into the vehicle is prevented.

According to another advantageous configuration of the invention, the components are made edge-shaped, especially at a right angle to the casings provided with armor plates. This enables better and simple overlapping of the components and thus an increase of the safety of the vehicle passengers. On the one hand a projectile cannot reach the vehicle interior by repeated deflection as a result of the right-angled structure of the components, on the other enough space can always be enabled in the gap for a necessary distance between the door leaf and the door frame which must always be maintained in the closed state of the door.

According to one advantageous configuration of the invention the components on the two sides, on the inside of the door leaf and of the door frame of the vehicle body, are made armored. In the case of an attack, relative to the vehicle the energy of the projectile or the energy of the splinter part is absorbed by the armored components such that injury to the passengers of the vehicle is prevented. According to the invention the components are made of a gunfire-inhibiting material, for example armor steel and/or of ballistic plastic, and/or ceramic. Based on the properties of the aforementioned materials, penetration of the projectiles or splinter parts is prevented and thus the vehicle is better protected against attacks.

According to one advantageous configuration of the invention the thickness of the components is such that they can be fitted into the gap. Optimum matching of the two components completely covers the gap so that attack injury to the vehicle passengers is avoided. With complete covering of the gap a labyrinth-shaped free distance is always maintained. This distance, as mentioned above, must always be maintained in the closed state of the vehicle door. The size of the armor thickness of the armored components of the vehicle door safety device as claimed in the invention can be determined depending on need and ballistic requirements. Advantageously the components of the vehicle door safety device have an armor thickness of at least 2 mm.

According to one advantageous configuration of the invention the components are each attached to the casing of the inside of the door leaf and the door frame of the vehicle body. The attachment to the casing provided with armor plates takes place preferably by weld joint and/or rivet joint and/or screw union and/or adhesive connection. In this way components are attached so securely to the casing that they are more resistant in case of attack.

BRIEF DESCRIPTION OF THE DRAWINGS

The invention is detailed below using one exemplary embodiment shown in the drawings. The sole FIGURE shows a horizontal section through a vehicle door with a door leaf and a door frame and a gap region between the two.

DETAILED DESCRIPTION OF THE PRESENT INVENTION

The FIGURE shows a door 1 of the vehicle which is not shown here. The door 1 consists of two parts, specifically of a door frame 2 of the vehicle body and a door leaf 3 which is shown here only from its inside. The door frame 2 consists of a casing 6 which runs peripherally along the side edges of the door frame 2 and is provided with armor plate 7. Furthermore the door frame 2 consists of a component 9 which is located on its casing 6. The component 9 which consists of an armored material, specifically of an armor steel, is made to run peripherally on the door frame 2 along the casing 6. The component 9 is attached along the door frame 2 to the casing 6 by welding. Attachment can also be done by weld joint or rivet joint and/or adhesive connection.

The second part of the door 1 of the vehicle which is not shown here consists of a door leaf 3 which is shown only from its inside and with its inside lies opposite the door frame 2 of the vehicle body. When the door 1 is closed and opened the door leaf 3 with the door frame 2 assumes a closed or open position. The inside of the door leaf 3 consists, like the door frame 2, of a casing 4 which runs peripherally on its side edges and which is provided with armor plate 5. The inside of the door leaf 3 also consists of a component 8 which is located along the door casing 4. The component 8 which likewise consists of an armored material, specifically of an armor steel, is made running peripherally on the inside of the door leaf 3 along the casing 4 of the entire door leaf 3. Like the component 9, the component 8 is also attached to its casing 4 by welding.

In a closed position of the door 1, the component 8 of the door leaf projects from the inside of the door leaf 3 into the gap 10 and runs along the entire gap 10. On the opposite door frame 2 a component 9 likewise runs around the entire door frame 2 and projects into the gap 10. For this purpose the component 8 on the inside of the door leaf 3 is made longer than the component 9 on the door frame 2 so that the component 8 completely encloses the component 9. The two components 8, 9 are made edge-shaped and right-angled. The two components 8, 9 are parallel to one another with an oblique angle and project into the gap 10. The gap 10 is double-covered from two sides. Thus all doors of the vehicle are armored with doubled gap covering. To ensure optimum protection for the vehicle passengers the design as claimed in the invention enables double protection against the action of any force from the outside.

The invention claimed is:

1. A vehicle door safety device for a vehicle comprising:

a door casing which runs peripherally on side edges of a vehicle door and which is located on an inside of a vehicle door leaf, and a body casing which is arranged running peripherally on a door frame of a vehicle body of the vehicle, wherein the door casing and the body casing mutually supplement one another in a complementary manner and are each made with at least one component that overlap one another in a closed position of the vehicle door, as a result of which a gap between the door casing and the body casing is covered, the components are made edge-shaped, and the components are made a right angle to the door casing and the body casing provided with armor plates.

2. The vehicle door safety device as claimed in claim 1, wherein the component from the inside of the door leaf and the component from the door frame are both made at least in one piece.

3. The vehicle door safety device as claimed in claim 1, wherein the component from the inside of the door leaf and the component from the door frame are sloped relative to one another and are arranged such that, in action of a force of a projectile on surfaces thereof, a plurality of reflections takes place.

4. The vehicle door safety device as claimed in claim 1, wherein the component on the inside of the door leaf overlaps, encompassing the component on the door frame.

5. The vehicle door safety device as claimed in claim 1, wherein the components are made such that each encompasses one of the door casing and the body casing.

6. The vehicle door safety device as claimed in claim 1, wherein the components on the inside of the door leaf and of the door frame are armored.

7. The vehicle door safety device as claimed in claim 6, wherein the components are made of a gunfire-inhibiting material.

8. The vehicle door safety device as claimed in claim 7, wherein the components are made of at least one of armor steel and of ballistic plastic, and ceramic.

9. The vehicle door safety device as claimed in claim 1, wherein a thickness of the components is made such that they can be fitted into the gap.

10. The vehicle door safety device as claimed in claim 1, wherein the components are each attached to one of the door casing of the inside of the door leaf and the body casing of the door frame.

11. The vehicle door safety device as claimed in claim 10, wherein the components are attached to the door casing of the inside of the door leaf and the body casing of the door frame by at least one of weld joint and rivet joint and screw union and adhesive connection.

12. The vehicle door safety device as claimed in claim 10, wherein the components are attached to the door casing of the inside of the door leaf and the body casing of the door frame by a weld joint.

13. The vehicle door safety device as claimed in claim 10, wherein the components are attached to the door casing of the inside of the door leaf and the body casing of the door frame by a rivet joint.

14. The vehicle door safety device as claimed in claim 10, wherein the components are attached to the door casing of the inside of the door leaf and the body casing of the door frame by screw union.

15. The vehicle door safety device as claimed in claim 10, wherein the components are attached to the door casing of the inside of the door leaf and the body casing of the door frame by adhesive connection.

16. The vehicle door safety device as claimed in claim 1, wherein:

the at least one component comprises a first component on the door casing and a second component on the body casing;

in the closed position of the vehicle door, the door casing is between the second component and the vehicle door leaf;

in the closed position, there is a free space between the vehicle door leaf and the door frame of the vehicle body;

in the closed position, an outer surface of the vehicle door leaf is aligned with an outer surface of the door frame of the vehicle body;

the first component and the second component are made of at least one of armor steel, ballistic plastic, and ceramic; and the first component and the second component are armored and have an armor thickness of at least 2 mm.

* * * * *